US005271618A

United States Patent [19]

Malwitz

[11] Patent Number: 5,271,618

[45] Date of Patent: Dec. 21, 1993

[54] BATTING PRACTICE DEVICE

[76] Inventor: Lonnie D. Malwitz, 9840 250th St., W. Lakeville, Minn. 55044

[21] Appl. No.: 988,772

[22] Filed: Dec. 10, 1992

[51] Int. Cl.[5] ..... A63B 69/40

[52] U.S. Cl. ..... 273/26 E; 273/29 A; 273/413

[58] Field of Search ..... 273/26 E, 58 C, 29 A, 273/196, 197 R, 198, 200, 200 A, 200 B, 208, 58 E, 414

[56] References Cited

U.S. PATENT DOCUMENTS

| | | | |
|---|---|---|---|
| 3,830,494 | 8/1974 | Biskup | 273/26 E |
| 4,010,950 | 3/1977 | Visockis | 273/26 E |
| 4,050,694 | 9/1977 | Domroski | 273/26 E |
| 4,664,375 | 5/1987 | Tetreault | 273/26 E |
| 4,793,612 | 12/1988 | Hammond | 273/26 E |
| 4,828,262 | 5/1989 | Henley | 273/26 E |
| 4,898,385 | 2/1990 | Love | 273/26 E |
| 5,000,450 | 3/1991 | Beintema | 273/26 E |

*Primary Examiner*—Theatrice Brown

*Attorney, Agent, or Firm*—Palmatier, Sjoquist & Helget

[57] ABSTRACT

A batting practice device is attachable to any of various existing permanent fixtures. The device includes a shock and energy absorbing elongate mount bar attachable to the fixture with a portion of the bar extending therebeyond. A metal mounting plate is affixed to the portion of the mount bar which extends beyond the fixture. The metal mounting plate supports a metal pipe affixed thereto suitably by welding. The pipe also has a portion extending from beyond the plate in-line with both the plate and the bar. A metal bushing is rotatably mounted and captured on the pipe portion extending from the plate. The metal bushing has a loop extending outwardly thereon. A piece of braided plastic rope with a hollow core has a first and second end. A ball is provided with a central aperture therethrough for passing the first end of the rope therethrough. The first end is further passed over the bushing, through the loop, into the hollow core the rope, through the ball aperture after which the first and second rope ends are tied into a knot that will not pass through the ball aperture.

25 Claims, 2 Drawing Sheets

BATTING PRACTICE DEVICE

BACKGROUND OF THE INVENTION

This invention relates to a batting practice device, and more particularly, to an improved batting practice device that is more inexpensive, durable and long lived than other prior batting practice device.

In general, such batting practice devices are a necessary tool to permit a ball player to practice daily, if desired, hitting a ball within the hitable strike zone for the baseball player. These devices permit the user to train his body, arms and eyes. An observer may coach the user with respect to the proper body stance and balance in learning and adapting the proper body mechanics for batting. With the aid of batting practice devices, an individual can learn to transfer his weight into hitting the ball, to slug the ball hard, to become a switch hitter and to develop confidence in a sense to see, hear and feel the crisp hard hit of a correctly batted ball.

There are, of course, many baseball and softball batting practice devices known in the prior art. The prior art devices are not completely satisfactory in all respects and do not provide the same flexibility, portability and overall advantages of the present invention. Such prior art devices are quite extravagant and complex rendering them quite expensive and not readily available to the average young baseball player for practice at home. Other types of batting devices appear somewhat flimsy and not durable thereby having a shortened life when compared to the present invention.

There is a need for a batting practice device that is easy to manufacture and relatively inexpensive, thereby making it available to young players as well as the older avid baseball and softball player enthusiast. The device must be of a durable construction as to not deteriorate or wear out upon the practicing hitters repeated inability to not directly hit the ball, but to hit other parts of the device. The device, therefore, must not only be durable but be of a long life construction that can take the hard abuse that the a training and learning baseball player may inflict on the batting practice device.

SUMMARY OF THE INVENTION

A batting practice device is attachable to any of various existing permanent fixtures. The device includes a shock and energy absorbing elongate mount bar attachable to the fixture with a portion of the bar extending therebeyond. A metal mounting plate is affixed to the portion of the mount bar which extends beyond the fixture. The metal mounting plate supports a metal pipe affixed thereto suitably by welding. The pipe also has a portion extending from beyond the plate in-line with both the plate and the bar. A metal bushing is rotatably mounted and captured on the pipe portion extending from the plate. The metal bushing has a loop extending outwardly thereon. A piece of braided plastic rope with a hollow core has a first and second end. A ball is provided with a central aperture therethrough for passing the first end of the rope therethrough. The first end is further passed over the bushing, through the loop, into the hollow core the rope, through the ball aperture after which the first and second rope ends are tied into a knot that will not pass through the ball aperture.

A principle object and advantage of the present invention is that it is of an extremely durable and long lived construction while yet remaining relatively simple, easy and inexpensive to manufacture.

Another object and advantage of the present invention is that the device can be mounted on any of a variety of permanent fixtures, such as a fence, post, building, tree or wall.

Another object and advantage is that the elongate mount bar of the device absorbs the impact, shock, vibration and energy forces transferred through the device which otherwise would be passed on through to the permanent fixture.

Another object and advantage of the present invention is that the device may be removed from the permanent fixture for safe keeping or transfer to another location.

DETAILED SPECIFICATION

Figure 1:
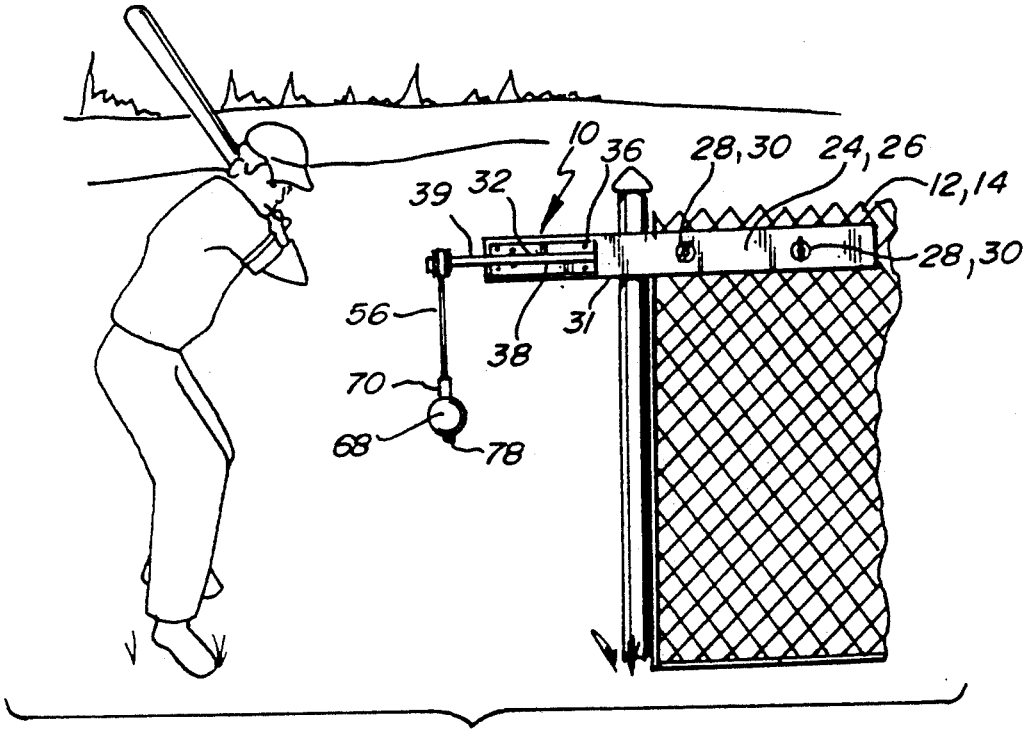
FIG. 1 is a front elevational view of the batting practice device of the present invention being utilized by a batter as the device is affixed to a fence.
Figure 4:
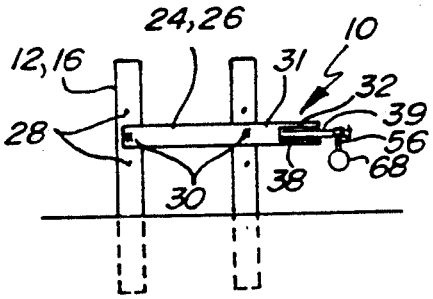
FIG. 4 is a front elevational view of the batting practice device mounted on fence posts.
Figure 5:
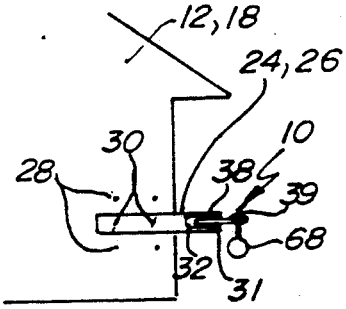
FIG. 5 is a front elevational view of the batting practice device mounted on an exterior wall of a building.
Figure 6:
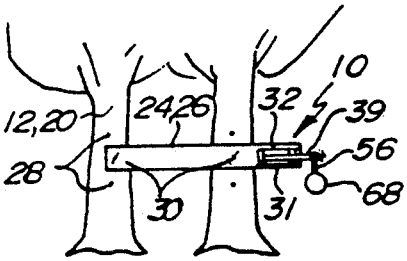
FIG. 6 is a front elevational view of the batting practice device mounted o to two adjacent trees.

The batting practice device 10 of the present invention may generally be seen in FIGS. 1–8. The device attaches to some existing permanent fixtures 12 with a vertical surface for suspending the batting practice device 10. The device includes an elongate mount bar 24, mounting plate 32, pipe 38, metal bushing 46, braided rope 56 and ball 68.

While the detailed structure assembly and operation of the batting practice device 10 is clearly shown in FIGS. 1–3A, samples of permanent fixtures 12 are shown in FIGS. 4–7. Examples of permanent fixtures might include a fence 14, posts 16, building 18, trees 20 and an interior wall 22.

More specifically, the batting practice device 10 includes an elongate mount bar 24 suitably made of a "2×4" board 26 approximately four feet in length. The bar 24 may be made of a variety of materials but Applicant has found that the wooden board 26 readily absorbs the impact, shock, vibration and energy forces which a batter will transfer from his bat (FIG. 1) to the device which otherwise may be transferred to the permanent fixture 12.

The mount bar 24 is appropriately releasably affixed or attached to the permanent fixture 12 by way of six inch hanger bolts 28 or the like. The bolts 28 are appropriately attached to the fixture perhaps in several vertically aligned locations for adjusting the batting practice device 10 either upwardly or downwardly to the strike zone of the user.

Approximately ¾ of the length mount bar 24 is to be mounted flush onto the vertical surface of the permanent fixture 12, where applicable. The bar 24 has apertures therethrough which receive the hanger bolts 28 therethrough. Thereafter washers and wingnuts may be rotatably affixed to the bolts to secure the mount bar 24 to the fixture 12. The mount bar 24 by this arrangement has a bar extending portion 31 approximating ¼ of the length of the overall mount bar 24.

At the bar extending portion 31 is appropriately affixed a mounting plate 32 which suitably is made of a zinc-plated heavy gauge steel. The plate 32 appropriately may be affixed to the bar extending portion 31 by way of screws, bolts or the like 36 at the plate's apertures 34.

Suitably affixed to the mounting plate 32, such as by welding, is a zinc-plated heavy gauge steel rod or pipe 38 which has a pipe extending portion 39 and an aperture 40 through the end of that portion 39. The aperture 40 receives a locking lynch pin 42 while intermediately of the pipe extending portion 39 is a stop washer 44 which is welded to the pipe 38.

A metal bushing 46 is also appropriately made of a zinc-plated heavy gauge steel. The metal bushing 46 may have grease 48 on its inner side for a low friction fit and to add lubrication as the bushing 46 is slid over and rotated on the pipe extending portion, stopped by the stop washer 44 and locked into place the lynch pin 42. The metal bushing 46 preferably has a first loop, ring or eyelet 50 and a generally opposing second loop, ring or eyelet 52 as will be appreciated. Between the bushing 46 and the lynch pin 42 is appropriately located a fender washer 54 to prohibit wear of the pin 42 by the friction of the rotating metal bushing 46.

A braided plastic rope 56 is utilized with this invention and is suitably made of a plastic, nylon or polypropylene material with interweave strands 58. A braided rope 56 of this type typically has a hollow core 60. The rope 56 may have a first end 62 and a second end 64. The rope is to pass through the central aperture 66 of a ball 68, suitably of the equivalent weight of a softball or baseball and appropriately made of ethylene vinyl acetate. The braided rope 56 appropriately is protected by a first vinyl sheath 70 located just above the ball 68 and second vinyl sheath rope guard or protector 72 which surrounds the braided rope at the metal bushing 46 area.

Figure 3:
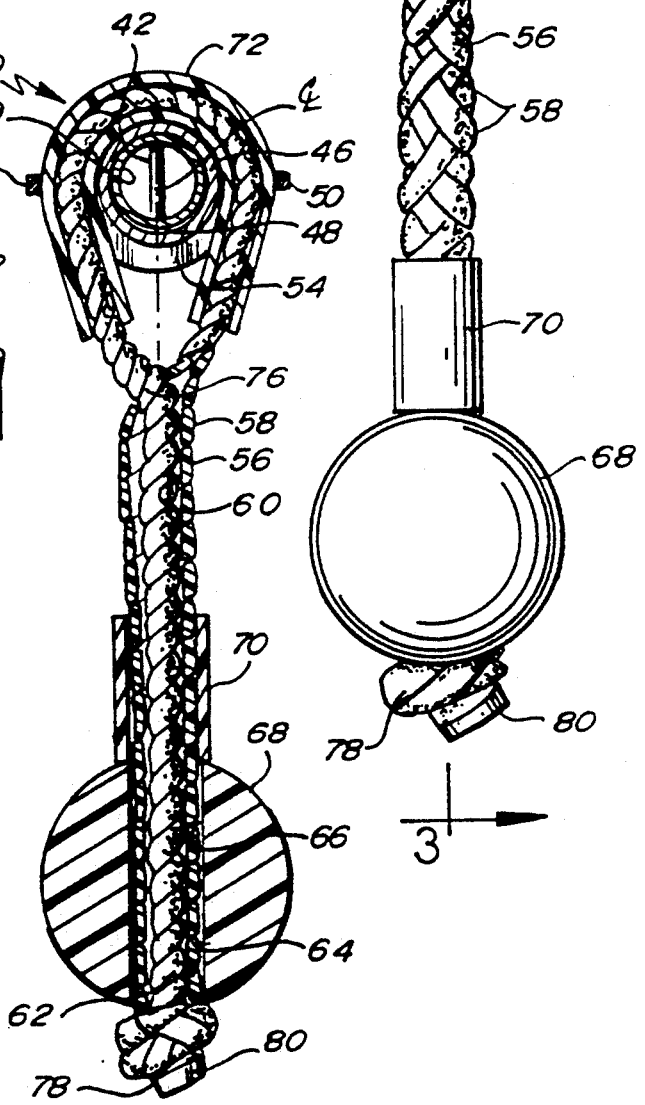
FIG. 3 is a cross-sectional view taken along lines 3—3 of FIG. 2
Figure 3A:
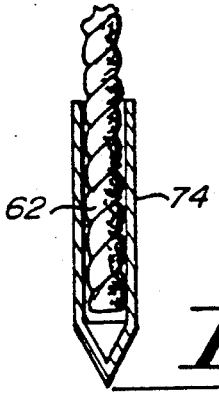
FIG. 3A is a front elevational view of the guide tool utilized in constructing the present invention.

Referring to FIGS. 3 and 3A, the assembly of the batting practice device 10 may be understood. The first end 62 of braided rope 56 is initially fed through the central apertures 66 of the ball 68. Thereafter the first vinyl sheath 70 is threaded over the first end 62 and slid downwardly to abut the ball 68. The first end 62 is then thread through the second vinyl sheath 72 which together with the braided rope is passed over the metal bushing 46 and through the first and second loops or rings 52. Thereafter, the first end 62 is inserted into the pointed hollow needle or guide tool 74. The pointed tool 74 is then inserted into the hollow core 60 of the braided rope 56 between the interweaved strands 58. The first end is guided along and within the hollow core as it is passed through the central aperture 66 of ball 68. Thereafter a knot 78 if formed suitably at the first 62 and second 64 ends after which the ends are heat sealed 80 together.

Next the lynch pin 42 is removed from the end of pipe 38. The metal bushing 46 is slid onto the pipe extending portion 39 up to the stop washer 44. Thereafter, fender washer 44 is slid onto pipe 38 and lynch pin 42 is again locked onto the pipe 38. The invention thereafter is assembled excepting only the affixation of the mounting plate 32 onto the elongate mount bar 24 or board 26 which in turn is affixed to a permanent fixture 12.

FIGS. 1 and 4 through 7 illustrate the various permanent fixtures 12 that the batting practice device 10 may be releasably connected thereto. It is appropriate to note that a plurality hanger bolts 28 may be vertically aligned as to move the elongate bar 24 either upwardly or downwardly to position the ball 68 in the strike zone of the batting operator.

Referring to FIG. 1, the batting operator, and perhaps a coach, can observe the rotation of the ball 68 and tell if the hit was popped up, pushed, pulled or slugged hard and straight forward from either behind or in front of the operator.

Figure 7:
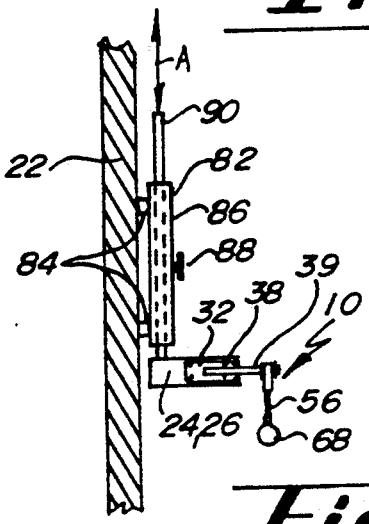
FIG. 7 is a front elevational view of the batting practice device mounted on the interior side of a wall shown in cross-section.
Figure 2:
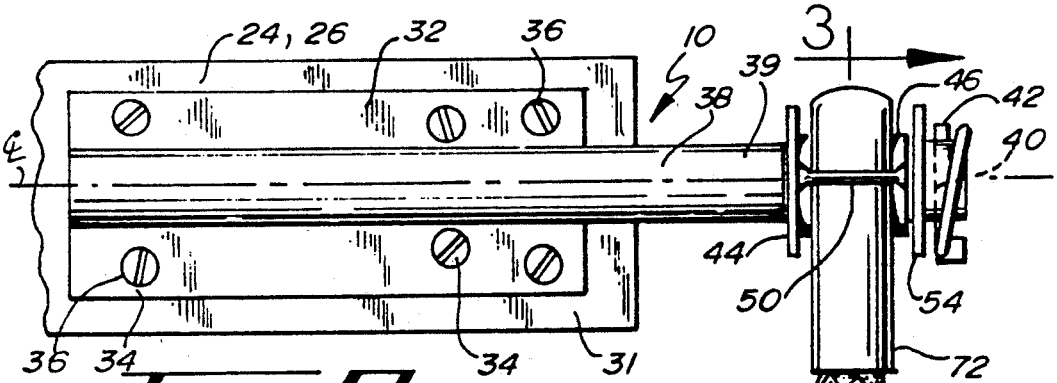
FIG. 2 is a front elevational view of the present invention with the elongate mounting bar broken away.

FIG. 7 shows an adjustable wall mount 82 for the inside of a building such as a gym. Hanger bolts or studs 84 are affixed into the wall 22. The bolts or studs 84 appropriately support an outer tube or sleeve 86 in a secure manner. Sleeve 86 supports a set screw with a handle 88. A device support rod 90 passes through the sleeve 86 and is adjustably held in vertical position by the inward turning of the set screw 88. Arrow A illustrates that the device support rod 90 may be moved upwardly or downwardly to appropriately position the ball 68 in the user's strike zone.

Figure 8:
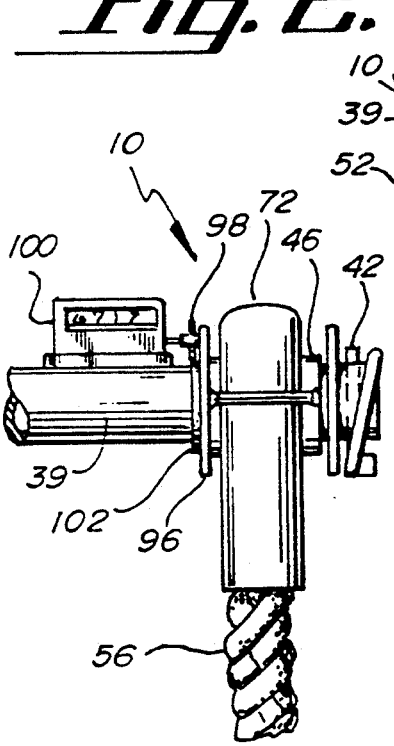
FIG. 8 is a front elevational view of the batting practice device partially broken away showing a revolution counter mechanism mounted thereon.

Referring to FIG. 8, the present invention may be fitted with a counter 94. Counter 94 is appropriately affixed to the pipe 38 adjacent a collar or washer 102 which takes the place of former stop washer 44. In place of former stop washer 44, a washer 96 is fixed to bushing 46 and supports a cog 98. As bushing 46 rotates about pipe 38, the cog 98 extending from washer 96 engages the sprocket of counter 100.

By this arrangement, the user or batting practitioner may count the number of revolutions of both the ball 68 and the bushing 46 to ascertain the force that the user has hit the ball 68. It is also appropriate that ball 68 be of substantially the same weight as a real baseball or softball to give the user the sensation of actually hitting a real ball.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A batting practice device attachable to an existing permanent structure comprising:

(a) an elongated shock and energy absorbing mount bar releasably attachable to a permanent structure along a length thereof with a portion thereof extending beyond a said permanent structure in a cantilever manner;

(b) a metal mounting plate attached to said portion of said bar beyond said structure, said plate having a metal pipe affixed thereto, said pipe having a portion thereof extending from said plate and mounting bar and being substantially parallel to both said plate and said mounting bar;

(c) a metal bushing rotatably mounted and captured on said pipe portion extending from said plate and said bar, means cooperating with said bushing to define a first loop on said bushing;

(d) a braided plastic rope of interweaved strands, said rope having a hollow core, a first end and a second end; and (e) a ball having a central aperture therethrough, said first end of said rope passing through said aperture, through said first loop, over bushing, into said hollow core and again through said aperture, whereat said first end and second end are tied together in a knot that will not pass through said ball aperture.

2. The batting practice device of claim 1, further comprising a protective sheath over said rope immediately above said ball.

3. Claim 1, further comprising a second protective sheath over the rope at said bushing.

4. Claim 1 wherein said mount bar is a wood board.

5. Claim 1, further comprising means cooperating with said bushing to define a second loop said second loop being generally opposite said first loop, said rope further passing through and being captured by both said loops.

6. Claim 1 wherein said metal bushing is captured on the extending pipe portion by washers.

7. Claim 1, further comprising a counter mounted on said pipe for counting said revolutions of the bushing.

8. Claim 1, further comprising means for vertically adjusting said device on a said permanent structure.

9. Claim 1, further including grease between said bushing and said pipe for lubrication.

10. A batting practice device attachable to an existing permanent structure comprising:

(a) an elongated shock and energy absorbing mount bar releasably attachable to a permanent structure along a length thereof with a portion of said bar extending beyond said structure in a cantilever manner;

(b) a metal mounting plate attached to said portion of said bar beyond said structure, said plate having a metal pipe affixed thereto, said pipe having a portion thereof extending from said plate and mounting bar and being substantially parallel to both said plate and said bar;

(c) a metal bushing rotatably mounted and captured on said pipe portion extending from said plate and bar; means cooperating with said bushing to define a first loop on said bushing;

(d) a braided plastic rope of interweaved strands, said rope having a hollow core, a first end and a second end;

(e) a ball having a central aperture therethrough, said first end of said rope passing through said aperture, through said first loop, over bushing, into said hollow core and again through said aperture, whereat said first end and said second end are tied together in a knot that will not pass through said ball aperture; and (f) a protective sheath over portions of said rope immediately above said ball and at said bushing.

11. Claim 10 wherein said mount bar is a wood board.

12. Claim 10, further comprising means cooperating with said bushing to define a second loop, said second loop being opposite said first loop, said rope further passing through said second loop captured by said first and second loops.

13. Claim 10 wherein said metal bushing is captured on said extending pipe portion by washers.

14. Claim 10, further comprising a counter mounted on said pipe for counting revolutions of said bushing when said ball is struck by a batter.

15. Claim 10, further comprising means for vertically adjusting said device on a said permanent structure.

16. Claim 10, further including grease between said bushing and said pipe for lubrication.

17. A batting practice device attachable to an existing permanent structure comprising:

(a) an elongated shock and energy absorbing mount bar releasably attachable to a permanent structure along a length thereof with a portion of said bar extending beyond a said permanent structure in a cantilever manner;

(b) a metal mounting plate attached to said portion of said bar beyond said structure, said plate having a metal pipe affixed thereto, said pipe having a portion thereof extending from said plate and mounting bar, and being substantially parallel to both said plate and said bar;

(c) a metal bushing rotatably mounted and captured on said pipe portion extending from said plate and said bar, means cooperating with said bushing to define a first and second generally opposite loops on said bushion;

(d) a braided plastic rope of interweaved strands having a hollow core, a first end and a second end; and (e) a ball having a central aperture therethrough, said first end of said rope passing through said aperture, through said first loop, over bushing through said second loop, then into said hollow core and again through said aperture, whereat said first and second ends are tied together in a knot that will not pass through said ball aperture.

18. The batting practice device of claim 17, further comprising a protective sheath over said rope immediately above said ball.

19. Claim 17, further comprising a second protective sheath over said rope at said bushing.

20. Claim 17 wherein said mount bar is a wood board.

21. Claim 17 wherein said metal bushing is captured on said extending pipe portion by washers.

22. Claim 17, further comprising a counter mounted on said pipe for counting said revolutions of the bushing when said ball is struck by a batter.

23. Claim 17, further comprising means for vertically adjusting said device on a said permanent structure.

24. Claim 17, further including grease between said bushing and said pipe for lubrication.

25. A batting practice device attachable to an existing permanent structure comprising:

(a) an elongated shock and energy absorbing wooden mounting bar releasably attachable to a permanent structure along a length thereof, with a portion of said bar extending beyond a said permanent structure in a cantilever manner;

(b) a metal mounting plate attached to said portion of said bar beyond said structure, said plate having a metal pipe affixed thereto, said pipe having a portion thereof extending from said plate and mounting bar and being substantially parallel to both said plate and said bar;

(c) a metal bushing rotatably mounted and captured on said pipe portion extending from said plate and said bar and having grease between said bushing and said bar, means cooperating with said bushing to define first and second generally opposite loops on said bushing;

(d) a braided plastic rope of interweaved strands, said rope having a hollow core, a first end and a second end;

(e) a ball having a central aperture therethrough, said first end of said rope passing through said aperture and through said first loop over said bushing, through said second loop into said hollow core and again through said aperture, whereat said first and said second ends are tied together into a knot that will not pass through said aperture;

(f) a protective sheath over a portion of said rope immediately above said ball and at said bushing; and (g) a counter mounted on said pipe for counting revolutions of said ball and said bushing after said ball is hit by a batter.

* * * * *

UNITED STATES PATENT AND TRADEMARK OFFICE
CERTIFICATE OF CORRECTION

PATENT NO. : 5,271,618

DATED : December 21, 1993

INVENTOR(S) : Lonnie D. Malwitz

It is certified that error appears in the above-identified patent and that said Letters Patent is hereby corrected as shown below:

In column 2, line 33, after the word "mounted", please replace "o" with --on--.

In column 5, line 65, after the words "second loop", please insert --and being--.

In column 6, line 10, after the word "absorbing", please insert --wooden--.

In column 6, line 24, after the word "define", please delete "a".

In column 6, line 63, after the words "parallel to", please delete "both".

In column 6, line 67, before the word "bar", please delete the word "said".

Signed and Sealed this

Twenty-fifth Day of October, 1994

*Attest:*

Bruce Lehman

BRUCE LEHMAN

*Attesting Officer*

*Commissioner of Patents and Trademarks*